US006179749B1

(12) United States Patent
Thorn et al.

(10) Patent No.: US 6,179,749 B1
(45) Date of Patent: Jan. 30, 2001

(54) RESISTANCE DEVICE

(75) Inventors: Richard P. Thorn; Denise M. Braeger, both of Erie, PA (US)

(73) Assignee: Lord Corporation, Cary, NC (US)

( * ) Notice: Under 35 U.S.C. 154(b), the term of this patent shall be extended for 0 days.

(21) Appl. No.: 09/040,694

(22) Filed: Mar. 18, 1998

(51) Int. Cl.[7] ..... A63B 23/00
(52) U.S. Cl. ..... 482/44; 482/45
(58) Field of Search ..... 482/44, 45, 46, 482/49, 47, 122, 114, 126, 127, 128; 601/40

(56) References Cited

U.S. PATENT DOCUMENTS

| | | | | |
|---|---|---|---|---|
| 1,023,756 | * | 4/1912 | Pons | 482/126 |
| 2,621,043 | | 12/1952 | Olmstead . | |
| 2,819,060 | | 1/1958 | Neidhart | 267/1 |
| 2,819,063 | | 1/1958 | Neidhart | 267/63 |
| 3,053,526 | | 9/1962 | Kendall | 267/1 |
| 3,216,259 | | 11/1965 | Bendix | 73/380 |
| 3,232,597 | | 2/1966 | Gaydecki | 267/8 |
| 3,583,530 | | 6/1971 | De Venne | 188/1 |
| 3,637,205 | | 1/1972 | Bankston | 272/68 |
| 3,820,634 | | 6/1974 | Poe | 188/1 C |
| 3,861,815 | | 1/1975 | Landaeus . | |
| 3,885,764 | | 5/1975 | Pabreza | 248/162 |
| 4,350,335 | * | 9/1982 | Pasbrig | 482/44 |
| 4,563,004 | | 1/1986 | Mattox | 272/131 |
| 4,580,778 | | 4/1986 | Noord | 272/131 |
| 4,623,146 | | 11/1986 | Jackson . | |
| 4,957,279 | | 9/1990 | Thorn | 267/140.5 |
| 5,257,680 | | 11/1993 | Corcoran et al. | 188/129 |
| 5,392,649 | | 2/1995 | Yoo et al. | 73/379.01 |
| 5,720,369 | | 2/1998 | Thorn et al. | 188/300 |

FOREIGN PATENT DOCUMENTS

| | | |
|---|---|---|
| 1183131 | 10/1985 | (SU) . |
| 1277975 A1 | 12/1986 | (SU) . |

OTHER PUBLICATIONS

Hand Therapy Catalog, North Coast Medical, 1996, p. 66.

* cited by examiner

*Primary Examiner*—Glenn E. Richman
(74) *Attorney, Agent, or Firm*—Randall S. Wayland; Michael M. Gnibus

(57) ABSTRACT

A resistance device (20) useful as a thumb or hand exerciser. The device (20) includes an outer member (32) including an axial through bore (34); an inner member (22) received within the through bore (34) and extending out of both its ends; and a friction member (36), such as an elastomer sleeve, immovably mounted on said inner member (22); said friction member (36) being in operable contact with the through bore (34) to provide resistance to relative axial movement between said inner (22) and outer (32) members. The level of resistance may be adjusted by rotating ends (24, 24')of the inner member (22) relative to one another such that the friction member (36) is axially compressed. Stops (30, 30') limit axial travel.

20 Claims, 4 Drawing Sheets

RESISTANCE DEVICE

FIELD OF THE INVENTION

The invention relates to resistance devices. In a more particular aspect, the present invention is directed to resistance device for thumb and/or hand exercise and rehabilitation.

BACKGROUND OF THE INVENTION

Various devices are known for rehabilitation/exercise of thumbs and hands. For example, U.S. Pat. No. 3,2616,259 to Bendix, Jr. teaches an exerciser for the thumb and grip with internal helical compression springs providing the resistance mechanism. SU 1985-10 and SU 1986-12 teach spring loaded devices for exercise of the hands and/or thumb. North Coast Medical offers a thumb exerciser sold under the trade name Thumbciser™ for thumb strengthening that includes a outer member including a through bore, and inner member extending through the bore and a rubber band(s) extending around the end of the inner member and secured to the outer member. Pressing on the inner member with the thumb stretches the rubber band(s) in the North Coast device. U.S. Pat. No. 4,580,778 to Van Noord teaches a Portable Exercising Apparatus With A Force Gauge. As best seen in FIG. 4 of Van Noord, the resistance mechanism is provided by an o-ring 116 which is slidably mounted around the inner tube 12 and which rides up a ramped or conical surface 114 of an annular brake mechanism. U.S. Pat. No. 3,637,205 to Bankston teaches a "Hand Exercising And Frictional Resistant-Type Exercising Device" having, as best seen in FIG. 4, a plastic outer tube 114 rotatably moveable on a slightly smaller diameter inner tube 111 having a coating 113 thereon.

These prior art exercise devices have general deficiencies in performance, complexity, and/or lack of adjustability. For example, the spring rate of some of the devices (ex. Bendix, Jr., SU 1986-12 and North Coast Medical devices) provide performance that gets progressively stiffer as the user compresses the spring with their thumb. Accordingly, there has been a long felt and unmet need for a simple and cost effective resistance device, such as for use in exercise of thumbs, hands, and the like which provides constant resistance and which may include an adjustability feature.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

The present invention provides a simple resistance device which may include adjustability of the level of resistance. The device finds excellent utility as a thumb and/or hand exerciser. In a first aspect, the resistance device includes an outer member including an axial through bore extending between first and second terminal ends; an inner member received within the through bore and extending out of both the first and second ends, and a friction member, such as an elastomeric sleeve, immovably mounted on the inner member and in operable sliding contact with the through bore thereby providing resistance to relative axial movement between said inner and outer members.

In another aspect, the level of resistance is user adjustable. The adjustability is preferably provided by an inner member further comprised of first and second end members which, when threaded into one another, provides axial compression of an elastomer friction member. This causes radial bulging of the member into contact with the through bore. The user can easily and variably adjust the level of precompression, and thus, the level of axial resistance, such as for exercising the thumb or hand.

In another aspect, at least one low friction washer is provided in contact with an axial end of the friction member thereby minimizing friction between the end member and the friction member and allowing for ease of rotational adjustment of the frictional resistance. Preferably one or more stops (which may be elastomer) are positioned at the ends of the inner member to limit axial travel of the inner member relative to the outer member. The device may optionally include calibration.

It is an advantage of the present invention that it provides an easily adjustable resistance device.

It is another advantage of the present invention that it provides a substantially constant force over the entire axial stroke.

It is an advantage of the present invention that it may provide exercise of a user's hands and thumb.

The above-mentioned and further features, advantages, and characteristics of the present invention will become apparent from the accompanying descriptions of the preferred embodiments and attached drawings.

BRIEF DESCRIPTION OF THE DRAWINGS

The invention will become better understood by reference to the description that follows, in conjunction with the appended drawings, in which.

DETAILED DESCRIPTION OF THE PREFERRED EMBODIMENT

Figure 1A:
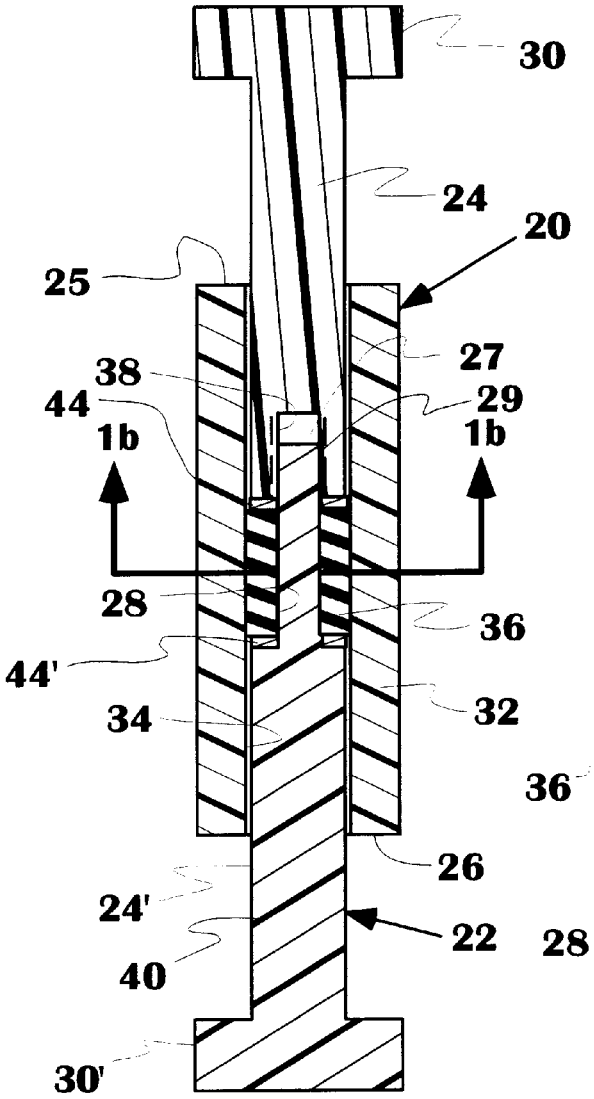
FIG. 1*a* is a longitudinal sectional view of the a first embodiment of resistance device in accordance with the present invention.
Figure 1B:
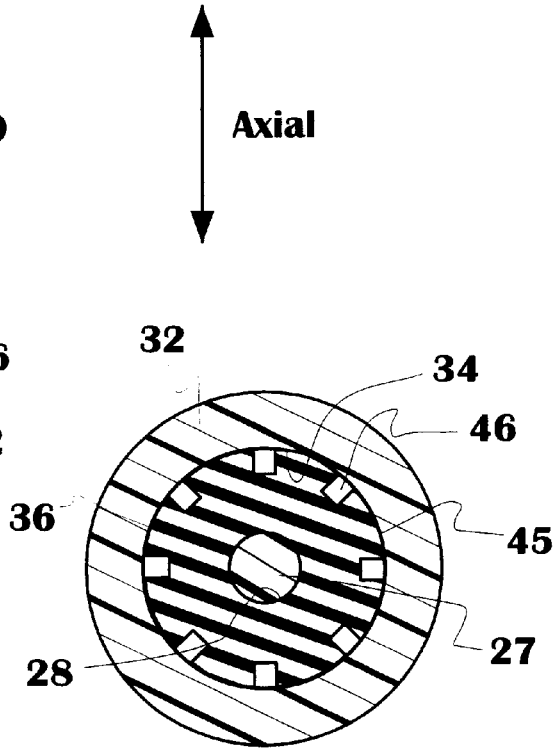
FIG. 1*b* is a lateral sectional view of a resistance device of FIG. taken along line 1*b*—1*b,*

A first embodiment of a resistance device 20 according to the invention is illustrated in FIG. 1*a*. The device 20 includes a outer member 32, an inner member 22, and a friction member 36. The outer member 32 is preferably rigid plastic, such as Nylon or PVC, cylindrically shaped and includes an axially directed through bore 34 extending through the outer member 32 from a first 25 to a second end 26. The preferably two-piece inner member 22 is received within the through bore 34 and extends out of both the first and second ends 25, 26 by a predetermined amount to achieve the desired stroke. The friction member 36, such as a natural rubber elastomeric sleeve, is immovably mounted on the inner member 22. By the term "immovably mounted", it is meant that the member 36 cannot move axially relative to the inner member 22 by any appreciable amount. The sleeve 36 is preferably slightly larger in diameter than the portion of the inner member 22 which it is mounted on; the sleeve 36 being received in the through bore 34.

Figure 3:
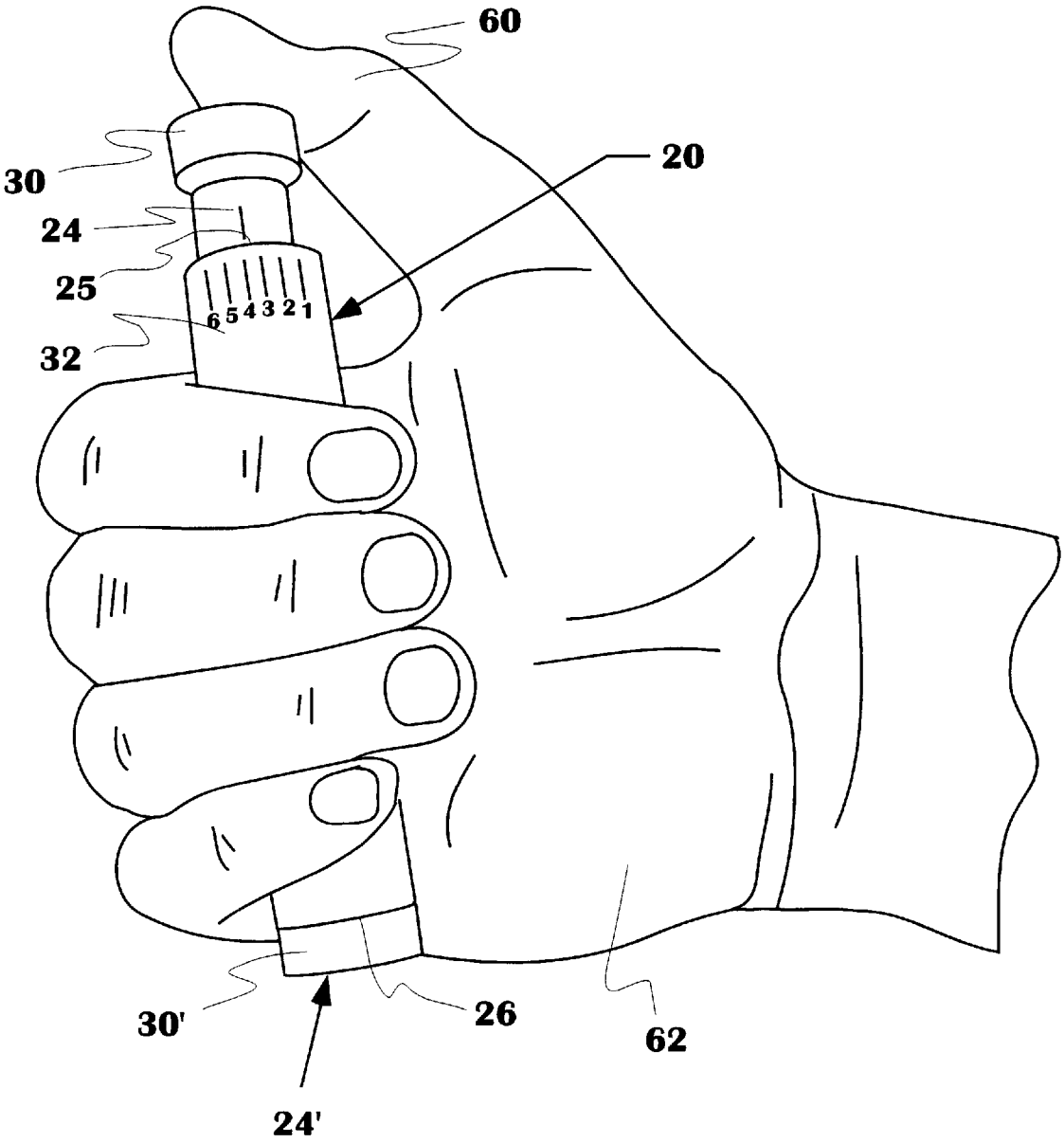
FIG. 3 is a frontal view of the resistance device in accordance with the present invention illustrating the resistance device in use as a thumb exerciser.

The friction member 36 is situated in operable sliding contact with the through bore 34 and provides the mechanism for providing resistance to relative axial movement between said inner member 22 and outer member 32. In this embodiment, the friction member 36 includes at least one depression 46, such as a groove, formed along an axial length thereof. More preferably, a plurality of grooves are included. The depressions or grooves 46 help to carry optional silicone grease available from Dow Corning, which helps provide a smoother feel when the user depresses the end member 24 or 24' (as best seen in FIG. 3). Optionally, the friction member 36 may include an elastomer, such as natural rubber compounded to include internal lubrication. For example, the internal lubrication may be provided by compounding in one of the known surface modifier additives. Preferably, the device 20 includes at least one, and more preferably two larger diameter (larger than the diameter of the through bore 34) limit stops 30, 30' positioned at either end of the inner member 22 which limit axial travel of the inner member 22 relative to the ends 25, 26 of the outer member 32 in either direction. In this embodiment, the stops 30, 30' are integral with, and made from the same material as the ends 24, 24' of inner member 22. By way of example, the ends 24, 24' are manufactured from a Dupont Delrin material, generically named Acetal, and are preferably formed by injection molding.

The first 24 and second 24' end members are preferably interconnected by threads. Threading the first end member 24 into the second end member 24' brings the inner ends of the members closer together and provides axial compression of the preferably annular-shaped elastomer friction sleeve 36. This causes radial bulging of the radial periphery 45 of the sleeve 36 into contact with the through bore 34 of the outer member 32, to be more thoroughly described later herein. Preferably, the first end member 24 includes a threaded bore 38, which preferably includes a ¼"–20 thread. The second end member 24' includes a first large diameter portion 40 and a smaller diameter pilot 27 having a like ¼"–20 threaded portion 29 thereon. The bore 28 through elastomer member 36 is received over the smaller diameter pilot 27 and threaded portion 29 of said pilot 27 is threaded into the threaded bore 38 of second end member 24.

Preferably, there are at least one, and more preferably two, low friction washers 44, 44', made of Nylon or other suitable low friction material, situated in contact with an axial end of the elastomer member 36. The washers 44, 44' are slightly smaller in diameter than the sleeve 36, such that they do not scrape against the through bore 34. The washers 44, 44' provides low friction contact surfaces allowing ease of rotational adjustment of the axial precompression by rotating the first end member 24 relative to the second end member 24'.

In operation, as the second end member 24' is threaded into the first end member 24, an axial force is provided against the end of the elastomer sleeve 36. This causes the length of the sleeve 36 to become slightly smaller. However, because elastomer, such as natural rubber is substantially incompressible, the elastomer sleeve will bulge radially into contact with the through bore 34. Therefore, further threading the second end member 24' into the first end member 24 increases the pressure applied by the elastomer sleeve 36 onto the through bore 34 and proportionately increases the resistance to axial relative movement of the inner member 22 relative to the outer member 32. This provides a smooth uniform feel throughout the full axial travel and a resistance force that is continuously adjustable from a point of virtually zero force to fully locked.

Figure 2A:
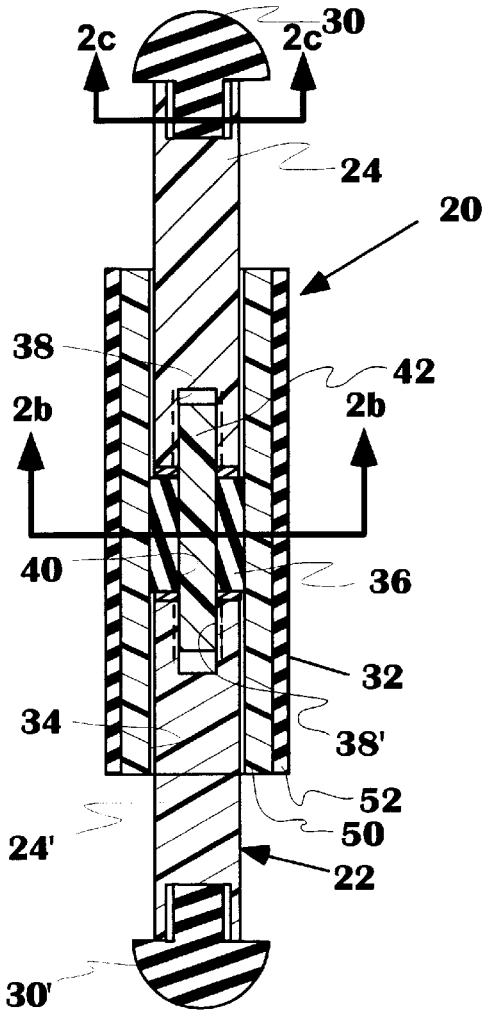
FIG. 2*a* is a longitudinal sectional view of a second embodiment of the resistance device in accordance with the present invention.
Figure 2C:
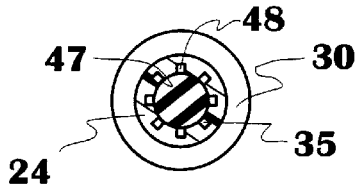
FIG. 2*c* is a lateral sectional view of the resistance device of FIG. 2*a* taken along line 2*c*—2*c;*
Figure 2B:
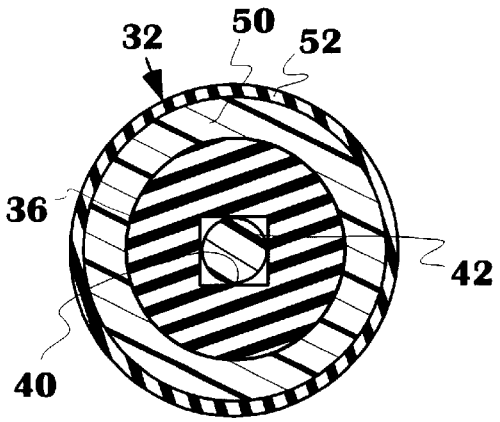
FIG. 2*b* is a lateral sectional view of the resistance device of FIG. 2*a* taken along line 2*b*—2*b;*

FIGS. 2*a*–2*d* illustrate another embodiment of resistance device 20 in accordance with the present invention. In this embodiment, each of the first and second end members 24, 24' of inner member 22 are identical. The mushroom shaped stops 30, 30' are provided by elastomer members, such as natural rubber, and more preferably by a Thermo-Plastic Elastomer (TPE), such as Santoprene of a durometer (shore A) of about 60. As shown in FIG. 2*c*, the end of member 24, is provided with a bore 47 having a plurality of axially directed grooves 48 formed therein. The stops 30, 30' are glued into the injection molded Dupont Delrin (Acetal) end members 24 and the adhesive 35 flows into the grooves 48 such that some mechanical as well as adhesive lock is provided between the stop 30 and the end member 24. A similar construction is found on the second end member 24'. Another difference is that a Nylon threaded rod 42 is used to thread into the threaded bores 38, 38' of end members 24, 24'; the bore 40 in sleeve 36 being received over the rod 42. In this embodiment, the sleeve includes a square-shaped bore. Another difference is that the outer member 32 is provided with an inner sleeve 50 of Nylon or PVC pipe and the outer sleeve 52 of a softer or more grippable material, such as a flexible PVC or a TPE, such as Santoprene. Preferably, the outer member 32 would be manufactured from a co-extruded Nylon and Santoprene pipe which is cut to the appropriate length (about 10 cm for the thumb exerciser application). Optionally, the outer member 32 may be molded or include some sort of profile formed in its outer surface (such as a finger profile grip) to better enable grasping the device.

Figure 2D:
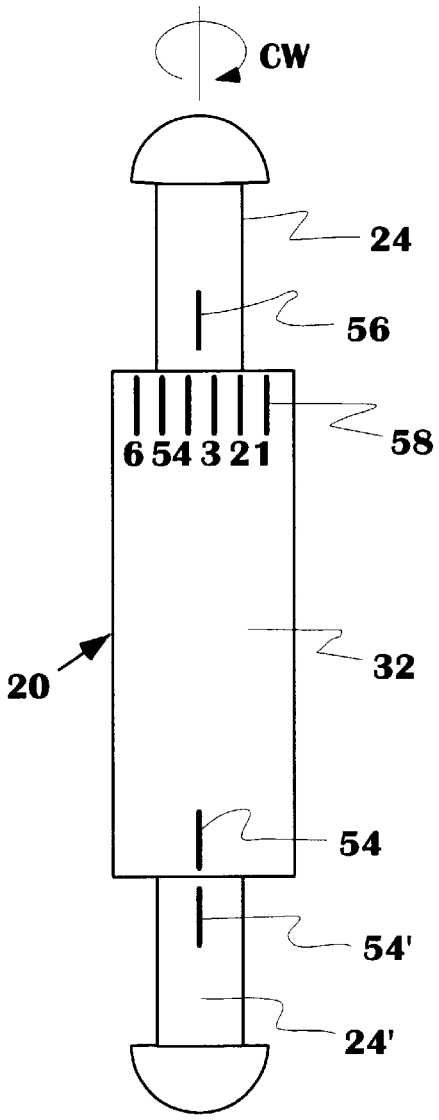
FIG. 2*d* is a frontal view of the resistance device of FIG. 2*a* illustrating calibrations.

As seen in FIG. 2*d*, the device 20 may include calibration markings, such that the level of axial resistance may be accurately set. For example, a first set of markings 54, 54' are provided on the second end member 24' and outer member 32, respectively. A second marking 56 is provided on the first end member 24. A plurality of third markings 58 which are radially spaced about the periphery of the outer member 32 provide the calibration feature. For example, the user first aligns marks 54 and 54' on the lower end. Then, holding the second end member 24' stationary relative to the outer member 32, the user will turn clockwise the first end member 24 to the appropriate setting (ex. 1–6). A setting of 1 provides a low level of resistance, whilst a setting of 6 provides a high level of resistance; the resistance level getting progressively greater as the user turns end 24 from 1–6 whilst holding end 24' stationary. This calibration feature provides that the level of resistance can be set for an individual user and some level of progress can be monitored as a patient's thumb function improves.

FIG. 3 illustrates the device 20 in use as a thumb exerciser. Once the level of resistance is set, the first end member 24 is depressed by the user's thumb 60 into the outer member 32. When the stop 30 hits the end 25 of outer member 32, the user will rotate the device 20 in their hand 62 (easily done by a quick one-handed flip) which positions the lower stop 30' into the upper (ready to be depressed) position, as shown. The user then depresses the former lower end member 24' again into the outer member 32 until the stop 30' hits the end 26 of the outer member 32. The device 20 is again flipped readying it for the next depression of the end member 24. These depressing and flipping actions are repeated as often as desired to accomplish exercise of the thumb and hand. The device 20 has the added benefits that it: 1) strengthens the grip and forearm as the user grasps the outer member 32, and 2) provides a dexterity exercise for the hands and thumbs.

Figure 4:
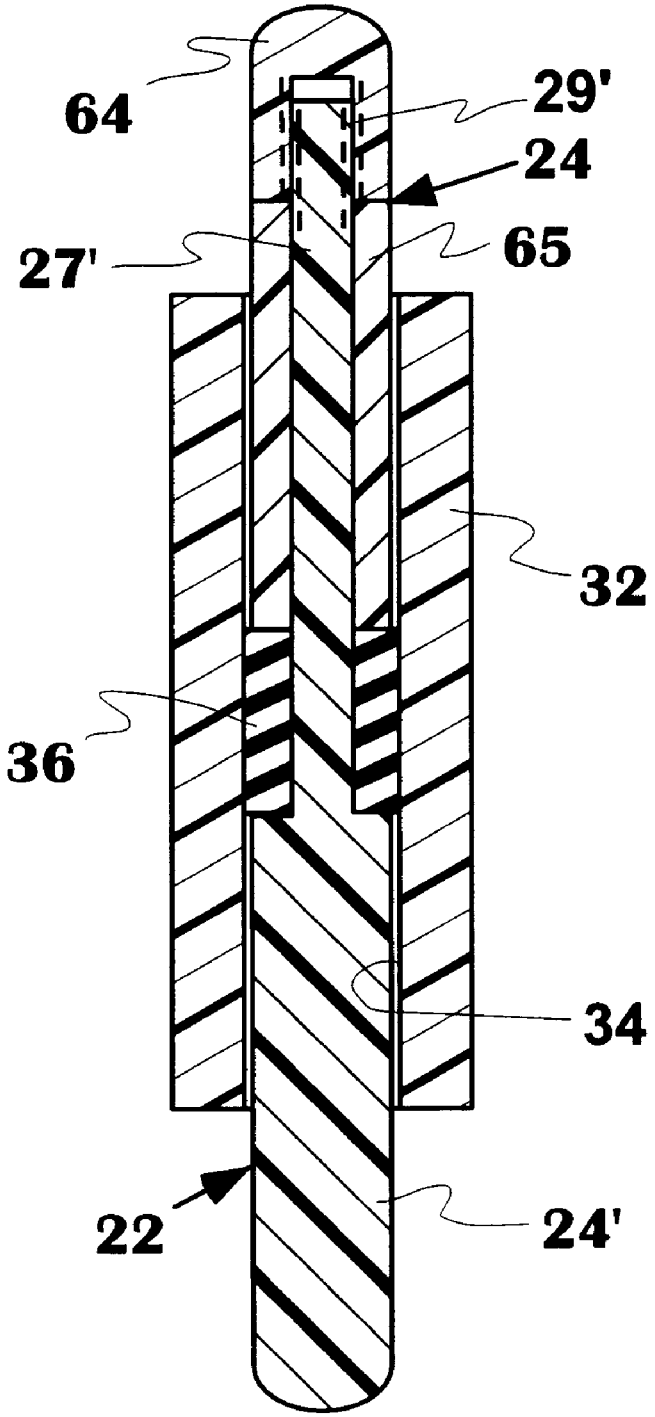
FIG. 4 is a longitudinal sectional view of a third embodiment of the resistance device of the present invention.

FIG. 4 illustrates another embodiment of the device 20. In this device 20, the inner member 22 is received within the outer member 32 in a fashion similar to the previous embodiments with the lower end 24' being similar to the FIG. 1*a* embodiment. However, the upper end 24 is comprised of a sleeve 65 which is received over pilot 27' and a cap 64 which is threaded on the threaded portion 29' of pilot 27'. The cap 64 and sleeve 65 may include calibrations marked thereon (not shown) such that the degree of resistance can be increased in increments by threading of cap 64 onto threads 29' whilst holding the sleeve 65, outer member 32 and lower end 24' stationary. Similar to the previous embodiments, this axially compresses the friction member 36 causing it to radially expand into the through bore 34. All plastic components are preferably manufactured from Nylon or Acetal, whilst the friction member is preferably internally lubricated natural rubber elastomer.

The invention has been described in terms of preferred structures, however, the particular examples given are meant to be illustrative and not limiting. Substitutions and equivalents as will occur to those skilled in the art are included within the scope of the invention as defined by the following claims.

What is claimed is:

1. A resistance device (20), comprising:

(a) an outer member (32) including an axial through bore (34) extending from a first end (25) to a second end (26);

(b) an inner member (22) received within said through bore (34) and extending out of both said first and second ends (25,26); and (c) an energy dissipative member (36) mounted on said inner member (22) yet restrained from axial movement along said inner member, said energy dissapative member (36) being in operable contact with said through bore (34) to provide constant resistance to relative axial movement between said inner (22) and outer (32) members.

2. The device (20) of claim 1 further including at least one stop (32) positioned on either end of said inner member (22) which limits axial travel of said inner member (22) relative to said outer member (32).

3. The device (20) of claim 2 wherein said at least one stop (32) further comprises an elastomer member.

4. The device (20) of claim 1 wherein said inner member (22) further comprises interconnected first (24) and second (24') end members.

5. The device (20) of claim 4 wherein threads interconnect said first (24) to said second (24') end member.

6. The device (20) of claim 4 wherein said first (24) to said second (24') end members are manufactured from a plastic material.

7. The device (20) of claim 4 wherein threading said first end member (24) into said second member (24') provides axial compression of said energy dissipative member (36) causing radial bulging into contact with said through bore (34).

8. The device (20) of claim 1 further comprising at least one low friction washer (44) in contact with an axial end of said energy dissipative member (36).

9. The device (20) of claim 1 further comprising a first low friction washer in contact with a first axial end of said elastomer member (36) and a second low friction washer (44') in contact with a second axial end of said elastomer member (36).

10. The device (20) of claim 1 wherein said energy dissipative member (36) comprises an annular sleeve.

11. The device (20) of claim 1 wherein said energy dissipative member (36) comprises an elastomer which is radially expandable.

12. The device (20) of claim 11 further including at least one depression (46) formed along an axial length of said elastomer member (36).

13. The device (20) of claim 1 wherein said inner member (22) includes a first end member (24) having a threaded bore (38) and a second end member having a first large diameter portion (25) and a smaller diameter pilot (27) including a threaded portion (29) extending from an end of said large diameter portion (25), said energy dissipative member being received over said smaller diameter pilot (27) and said threaded portion (29) of said pilot (27) being threaded into a threaded bore(38) of said second end member (24).

14. The device (20) of claim 1 wherein said inner member (22) includes first and second end members (24, 24') each having a threaded bore (38), a threaded rod received in each threaded bore (38), said energy dissipative member (36) being received over the threaded rod.

15. The device (20) of claim 1 wherein elastomer members located at either end of said inner member comprise stops which limit axial travel of said inner member relative to said outer member.

16. The device (20) of claim 1 wherein said outer member is manufactured from a plastic material.

17. The device (20) of claim 1 including an polymer sleeve surrounding said outer member to provide a gripping surface for a user's hand.

18. A resistance device (20), comprising:

(a) an outer member (32) including an axial through bore (34) extending from a first (25) to a second (26) axial end;

(b) an inner member (22) received within said through bore (34) and extending out of both said first and second ends (25, 26), said inner member including a first end member (24) coupled to a second end member (24');

(c) an elastomeric sleeve member (36) mounted adjacent to respective ends of said first or second end members whereby threading said first end member (24) into said second end member (24') provides axial compression of said elastomer sleeve member (36) thereby causing said sleeve member (36) to bulge into radial contact with said through bore (34) to provide resistance to axial movement between said inner (22) and outer (32) members.

19. A resistance device (20), comprising:

(a) a cylindrical outer member (32) including an axial through bore (34) extending from a first (25) to a second (26) axial end;

(b) an inner member (22) received within said through bore (34) and extending out of both said first and second ends (25, 26), said inner member (22) including a first end member (24) threadedly interconnected to a second end member (24'), each of said end members including a stop which limits travel of said inner member relative to said outer member;

(c) a elastomer sleeve member (36) mounted adjacent to said first or second end members whereby threading said first end member (24) into said second end member (24') provides axial compression of said sleeve member (36) thereby causing said sleeve member (36)

to bulge into radial contact with said through bore (34) and provide resistance to axial movement between said inner (22) and outer (32) members.

20. A resistance device, comprising:

a) an outer member including an axial bore, b) an inner member received within the bore, c) a friction member mounted to the inner member and engaging the axial bore, the friction member comprising an elastomer sleeve with a plurality of depressions formed along an axial length thereof.

* * * * *